US005908152A

United States Patent [19]

Tullis

[11] Patent Number: 5,908,152

[45] Date of Patent: Jun. 1, 1999

[54] MULTI-COMPARTMENT BOX INCLUDING A LID

[75] Inventor: Stephen D. Tullis, West Chester, Ohio

[73] Assignee: Burrows Paper Corporation, Franklin, Ohio

[21] Appl. No.: 08/933,050

[22] Filed: Sep. 18, 1997

[51] Int. Cl.[6] ..... B65D 25/04

[52] U.S. Cl. ..... 229/120.16; 229/148; 229/120.17; 229/145; 229/906; 229/114

[58] Field of Search ..... 229/120.16, 120.17, 229/114, 145, 146, 148, 902, 906, 125.26, 125.29

[56] References Cited

U.S. PATENT DOCUMENTS 1,511,678 10/1924 Schwartzberg ..... 229/148 X
2,135,678 11/1938 Scotcher ..... 229/120.17 X
3,876,132 4/1975 Kuchenbecker .
4,081,125 3/1978 Meyers .
4,313,554 2/1982 Montealegre ..... 229/120.17 X
4,431,128 2/1984 Dirico .
4,848,648 7/1989 Eisman .
4,930,681 6/1990 Fultz et al. .
4,944,451 7/1990 Forbes, Jr. .
5,332,148 7/1994 Liu et al. ..... 229/120.17
5,356,070 10/1994 Rigby ..... 229/120.17
5,419,486 5/1995 Bennett et al. .
5,588,583 12/1996 Cargile, Jr. .

*Primary Examiner*—Gary E. Elkins
*Assistant Examiner*—Tri M. Mai
*Attorney, Agent, or Firm*—Dinsmore & Shohl LLP

[57] ABSTRACT

A multi-compartment box comprising a compartment portion including two compartments with a divider therebetween, and a lid connected to the compartment portion by a hinge. The divider between the two compartments is arranged substantially normal to the hinge which connects the lid to the compartment portion of the box. The box is formed from a unitary blank of semi-rigid material.

24 Claims, 3 Drawing Sheets

MULTI-COMPARTMENT BOX INCLUDING A LID

FIELD OF THE INVENTION

The present invention relates to a multi-compartment box including a lid, and more specifically, the present invention relates to a multi-compartment box which is formed from a unitary blank of a semi-rigid material.

BACKGROUND OF THE INVENTION

Various multi-compartment boxes are known in the art. Conventionally, multi-compartment boxes has been formed from foamed plastic materials, for example polystyrene, as such materials provide good heat insulation. However, multi-compartment polystyrene boxes are disadvantageous in that they cannot be shipped or stored in an unconstructed or unassembled planar form, they cannot be easily preprinted, and they are perceived as environmentally unfriendly owing to recycling difficulties associated with such materials.

Multi-compartment boxes formed from paper, paperboard or other paper-based materials are also known in the art as set forth, for example, in the Meyers U.S. Pat. No. 4,081,125, the Dirico U.S. Pat. No. 4,431,128, the Forbes, Jr. U.S. Pat. No. 4,944,451 and the Cargile, Jr. U.S. Pat. No. 5,588,583. Multi-compartment boxes including lid structures and formed from paper, paperboard or the like are further disclosed in the Kuchenbecker U.S. Pat. No. 3,876,132, the Eisman U.S. Pat. No. 4,848,648, the Fultz et al U.S. Pat. No. 4,930,681 and the Bennett et al U.S. Pat. No. 5,419,486. Generally, the multi-compartment box structures formed from a single blank of material are advantageous in that they may be shipped in the planar blank form in order to conserve space prior to assembly. However, depending on the shape and structure of the blank, the assembled boxes of the prior art provide varying degrees of strength and storage convenience in the assembled state and, depending on the blank material, varying degrees of heat insulation and printability. However, owing to the desirable recyclability of paperboard boxes, there is a continuing need for improved box structures which can be easily assembled from a single blank for various uses.

SUMMARY OF THE INVENTION

Accordingly, it is an object of the present invention to provide a multi-compartment box including a lid which overcomes disadvantages of the prior art. It is a more specific object of the present invention to provide a multi-compartment box including a lid which is formed from a single unitary blank of material. It is a further object of the invention to provide a multi-compartment box including a lid which is easily and readily assembled from a single blank of paper-like material and which is of a sturdy construction. An additional object of the invention is to provide a multi-compartment box which is assembled from a single blank and which has good heat insulation properties and/or is easily preprinted. It is yet a further object of the invention to provide a multi-compartment box including a lid wherein a plurality of such boxes, when assembled, can be easily and conveniently stacked or nested for efficient storage.

These and additional objects and advantages are provided by the multi-compartment box according to the present invention. In one embodiment, the multi-compartment box comprises a compartment portion having two compartments with a divider therebetween and a lid connected to the compartment portion by a hinge. The compartment portion and the lid are folded from a unitary blank of semi-rigid material, preferably paper-based, and the divider is substantially normal to the hinge.

In a second embodiment, the multi-compartment box is formed from a unitary blank of semi-rigid material, preferably paper-based, and comprises first and second divider panels, first and second compartment panels, first and second side walls, first and second front walls, first and second rear walls and a lid. The first and second divider panels each have opposed front and rear edges and inner and outer edges, with the inner edge of the second divider panel being connected to the inner edge of the first divider panel along a divider fold line. The first and second compartment panels each have opposed front and rear edges and inner and outer edges, with the inner edges of the first and second compartment panels being connected respectively to the outer edges of the first and second divider panels, respectively, along first and second compartment fold lines. Preferably, each compartment fold line is substantially parallel to the divider fold line. The first and second side walls each have opposed front and rear edges and inner and outer edges, with the inner edges of the first and second side walls being connected, respectively, to the outer edges of the first and second compartment panels, respectively, along first and second side wall fold lines. Preferably, each side wall fold line is substantially parallel to the divider fold line. The first and second front walls have opposed bottom and top edges and inner and outer edges, with the bottom edges of the first and second front walls being connected, respectively, to the front edges of the first and second compartment panels along first and second front wall fold lines. The first and second rear walls have opposed bottom and top edges and inner and outer edges, with the bottom edges of the first and second rear walls being connected, respectively, to the rear edges of the first and second compartment panels along first and second rear wall fold lines. The lid is connected to the first rear wall by a hinge which extends substantially normal to the divider fold line.

The multi-compartment box according to the present invention is advantageous in that it is formed from a single unitary blank which may be efficiently and conveniently stored in its planar form. The blank may be easily assembled to provide the multi-compartment box including a lid. The multi-compartment box is of a strong construction and conveniently provides multiple compartments together with a lid. A plurality of the boxes may be easily stacked in their assembled form in a nesting relation to provide additional storage efficiency and convenience prior to use.

Additional objects, advantages and other features of the invention will be set forth and will become apparent to those skilled in the art upon examination of the following detailed description, or may be learned with practice of the invention. As will be realized, the invention is capable of other different obvious aspects, all without departing from the invention. Accordingly, the drawings and description will be illustrative in nature and shall not be viewed as restrictive.

BRIEF DESCRIPTION OF THE DRAWINGS

The accompanying drawings, incorporated in and forming part of the specification, illustrate several aspects of the present invention, and together with the following detailed description, serve to explain the invention. In the drawings.

DETAILED DESCRIPTION OF THE PREFERRED EMBODIMENT

This invention pertains to a multi-compartment box including a lid, which is formed from a unitary blank of semi-rigid, preferably paper-based, material. According to this invention, a single blank of the material is impressed, optionally scored, and cut such that, upon assembly, a multi-compartment box is formed. The box includes a lid and a compartment divider that is substantially normal to the hinge that connects the compartment portion of the box to the lid. The walls of the box and lid are tapered according to a preferred embodiment of this invention to allow a plurality of the assembled boxes to be easily and efficiently nested and stacked, with the height of the resultant stack being minimized.

The blank for making the multi-compartment box with lid is preferably constructed of a paper-based material such as cardboard, corrugated cardboard or the like. A preferred corrugated material is the type known as F-flute size corrugated material. This material is preferred as it is thin and of low weight, but has high strength and possesses excellent thermal insulation characteristics. Generally, the paper-based materials are also advantageous in that they are printable. The paper-based material may include a liquid or grease resistant coating, if desired.

Generally, the blank is impressed and cut such that it comprises two compartment panels, and a lid panel. Each panel has walls integral therewith. Impressed fold lines are provided between the walls and the panels so that the walls can be assembled at desired angles with respect to the panels. In one embodiment, an interlocking tab and slot system are provided on the walls and extensions thereof that utilize an arcuate-shaped fold line to present the lid with a secure locking function.

Figure 1:
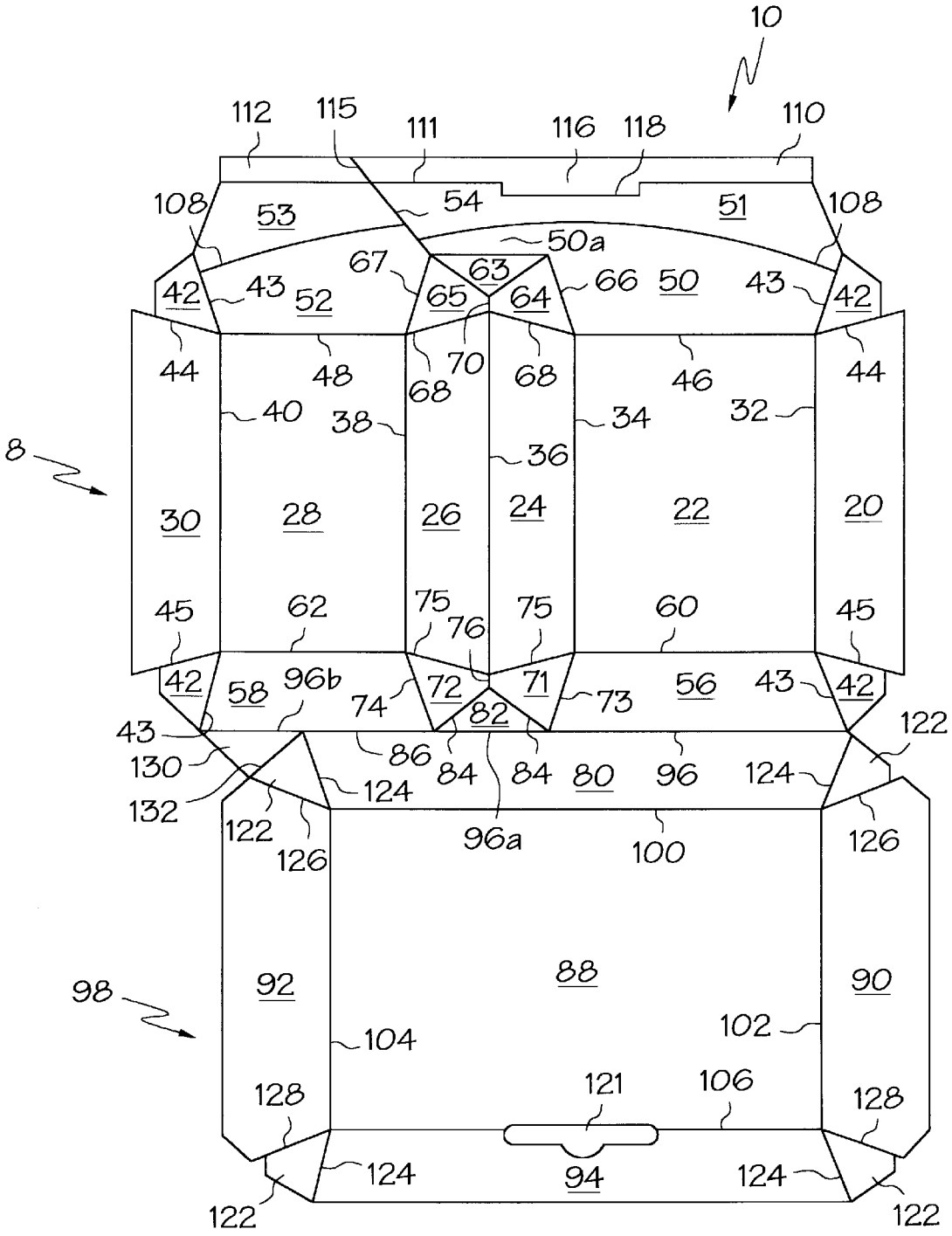
FIG. 1 is a plan view of the inside surface of a blank for a box embodying features of the present invention.

FIG. 1 shows a single unitary blank 10 for forming a multi-compartment box in accordance with one embodiment of this invention. The blank 10 is impressed, scored and cut as described in detail below to include a first side wall 20, a first compartment panel 22, a first divider panel 24, a second divider panel 26, a second compartment panel 28, and a second side wall 30. A first side wall fold line 32 connects the adjacent inner edge of the side wall 20 and outer edge of the panel 22, and a first compartment fold line 34 connects the adjacent inner edge of the panel 22 and outer edge of the divider panel 24. A divider fold line 36 connects the inner edge of the divider panels 24 and 26. A second compartment fold line 38 connects the adjacent outer edge of the divider panel 26 and inner edge of the panel 28, and a second side wall fold line 40 connects the adjacent outer edge of the panel 28 and inner edge of the side wall 30.

In a preferred embodiment, each of the fold lines 32, 34, 36, 39 and 40 are substantially parallel to one another, and in a further preferred embodiment are of substantially equal length, whereby the compartment panels 22 and 28 are substantially rectangular. Although the first compartment panel 22 and second compartment panel 28 are shown in FIG. 1 as being of unequal width, in a further embodiment, panels 22 and 28 may have equal compartment panel widths. The divider fold line 26 may also be perforated in order to facilitate the separation of one compartment of the box from the other when the blank is assembled to form the box.

Joined to the front edges of the first compartment panel 22 and the second compartment panel 28 by means of first and second front wall fold lines 46 and 48, respectively, are first and second front walls 50 and 52, respectively. In a preferred embodiment, the blank further includes first and second closure extensions 51 and 53, respectively, connected to the top edges of the front walls 50 and 52, respectively, by an extension fold line 108. The closure extensions 51 and 53 are separated from each other by a closure extension cut line 54. In a preferred embodiment, the extension fold line 108 is impressed upon the blank so that, upon assembly of the box, the extension fold line has a substantially arcuate shape. The shape of the extension fold line 108 provides the closure extensions 51 and 53 with limited flexibility and therefore the extensions provide strength and integrity to the lid closure structure and latching means.

Extending from the top edges of the closure extensions 51 and 53 are first and second closure flaps 110 and 112, respectively, each of which are connected to the closure extensions by a closure flap fold line 111 and are separated from each other by a closure flap cut line 115. The cut line 115 is preferably colinear with the closure extension cut line 54. Optionally, an interlocking tab 116 or the like is formed on at least one of the closure flaps 110 and 112. In a preferred embodiment, the tab 116 is formed from an adjacent portion of at least one of the closure extensions 51 and 53 by making a substantially U-shaped slit 118 in the closure extension, the slit starting and ending on or about the closure flap fold line 111. The U-shaped slit 118 and the closure flap fold line 111 thereby form the interlocking tab 116 from one of the closure extensions 51 and 53.

Joined to the rear edges of the first compartment panel 22 and the second compartment panel 28 by means of first and second rear wall fold lines 60 and 62, respectively, are first and second rear walls 56 and 58, respectively. Extending from the top edge of the first rear wall 56 is a lid 98 which is connected to the first rear wall 56 by a hinge 96. In one embodiment, the hinge 96 may be perforated in order to facilitate the separation of the lid 98 from the assembled box.

As will be apparent from the thus described unitary blank, the multi-compartment box will comprise a first compartment, the bottom panel of which is formed from panel 22 and the sides of which are formed from panels 20, 24, 50 and 56, and a second compartment, the bottom of which is formed from panel 28 and the sides of which are formed from panels 26, 30, 52 and 58. To assemble the compartments, the blank is folded along the divider fold line 36, with the outer edges of panels 24 and 26 and panels 22 and 28 being moved towards one another. Panels 20 and 30 are folded along fold lines 32 and 40, respectively, to form the side walls of the respective compartments. In a similar manner, walls 50 and 52 are folded along the respective fold lines 46 and 48 to form the front walls of the compartments and rear walls 56 and 58 are folded along lines 60 and 62 to form the rear walls of the compartments. As the blank is folded along the divider fold line 36, the top edge of the rear wall 58 is aligned with the lid of the box, as set forth in FIG. 2. As is apparent from the figures, the divider formed from the divider fold line 36 and the divider panels 24 and 26 is substantially normal to the hinge 96.

In a preferred embodiment, as shown in FIG. 1, the lid 98 comprises a lid rear wall 80 that extends from the first and second rear walls 56 and 58 and is connected at its bottom edge to the top edge of the first rear wall 56 by the hinge 96. The lid rear wall 80 is separated from the top edge of the second rear wall 58 by a second rear wall cut line 86. A rear lid fold line 100 connects the top edge of the lid rear wall to the rear edge of a lid panel 88. At opposite sides of the lid panel 88, first and second lid side walls 90 and 92, respectively, are connected to the lid panel by first and second side lid fold lines 102 and 104, respectively. A lid front wall 94 is connected to the lid panel 88 at its front edge by a front lid fold line 106. A slot 121 may be provided on the lid for receiving the interlocking tab 116.

Extending from the inner edge of each of the first and second front walls 50 and 52 are first and second front divider tabs 64 and 65, respectively, which are connected to the inner edges of the front walls by first and second front divider tab fold lines 66 and 67, respectively. The front divider tabs 64 and 65 are separated from one another by a front divider tab cut line 70. Additionally, the first and second front divider tabs 64 and 65 are respectively adjacent to but separated from the front edges of the first and second divider panels 24 and 26 by front divider cut lines 68. In an alternate embodiment, the first and second front divider tabs 64 and 65 may be connected via fold lines with the front edges of the first and second divider panels 24 and 26, respectively, whereby the front divider tab fold lines 66 and 67 would be replaced with the front divider cut lines 68, and vice versa. The front divider tabs 64 and 65 may be tapered to prevent them from extending past the divider fold line when the blank is assembled to form the box.

In a preferred embodiment, the front divider tabs 64 and 65 are spaced from and below the bottom edge of at least one extended portion, indicated at 50*a* in FIG. 1, of one of the first and second front walls 50 and 52 to define a cut out area 63. In a further preferred embodiment, the cut out area 63 is substantially triangular. The geometry of the cut out area 63, however, is not limited to a triangular shape. For example, the cut out area 63 may be in the form of a cut line or it may define a tab extending from one of the first and second front walls 50 and 52, whereby the tab would be separated from the first and second front divider tabs 64 and 65 by the cut out area.

In a further preferred embodiment, as shown in FIG. 1, first and second rear divider tabs 71 and 72, respectively, extend from the inner edges of the first and second rear walls 56 and 58, respectively, where the rear divider tabs are connected to the rear walls by first and second rear divider tab fold lines 73 and 74, respectively. The rear divider tabs 71 and 72 are separated from one another by a rear divider tab cut line 76. Additionally, the rear divider tabs 71 and 72 are respectively adjacent to but separated from the rear edges of the first and second divider panels 24 and 26 by rear divider cut lines 75. In a further embodiment, the first and second rear divider tabs 71 and 72 may instead be connected via fold lines with the rear edges of the first and second divider panels 24 and 26, respectively, whereby the rear divider tab fold lines 73 and 74 would be replaced with the rear divider cut lines 75, and vice versa. The rear divider tabs 71 and 72 may also be tapered in order to prevent them from extending past the divider fold line when the blank is assembled to form the box.

In a preferred embodiment, the rear divider tabs 71 and 72 are spaced from and arranged below the lid rear wall 80 as shown in FIG. 1. In a further embodiment, the lid 98 or lid rear wall 80 may extend into a space defined between the rear divider tabs 71 and 72 and the hinge 96 to define a compartment hinge tab 82. The compartment hinge tab 82 is connected to the lid 98 or lid rear wall 80 by a portion of the hinge 96 indicated at 96*a*, and is separated from the rear divider tabs 71 and 72 by compartment hinge tab cut lines 84. Although the preferred shape of the compartment hinge tab 82 is substantially triangular as shown in FIG. 1, other geometries, such as trapezoids, may also be embodied in accordance with this invention.

In a further preferred embodiment, corner tabs 42 extend from each outer edge of the first and second front walls 50 and 52 and first and second rear walls 56 and 58. The corner tabs 42 are connected to the front and rear walls by corner tab fold lines 43. Each corner tab 42 connected with the front walls 50 and 52 is positioned adjacent to and separated from the front edge of one of the side walls 20 and 30, respectively, by a front corner tab cut line 44. Each corner tab 42 connected with the rear walls 56 and 58 is positioned adjacent to and separated from the rear edge of one of the side walls 20 and 30, respectively, by a rear corner tab cut line 45, as also shown in FIG. 1.

Similarly, in the embodiment of the blank 10 shown in FIG. 1, the blank includes lid corner tabs 122 extending from each side edge of the lid front and rear walls 94 and 80, respectively. The lid corner tabs 122 are connected to the lid front and rear walls by lid corner tab fold lines 124. Each lid corner tab 122 connected with the lid front wall 94 is positioned adjacent to and separated from the front edge of one of the lid side walls 90 and 92 by a front lid corner tab cut line 126. Each lid corner tab 122 connected with the lid rear wall 80 is positioned adjacent to and separated from the rear edge of one of the lid side walls 90 and 92 by a rear lid corner tab cut line 128. In a preferred embodiment, the corner tabs 42 and lid corner tabs 122 are tapered to a shape which facilitates their positioning along the respective side walls and prevents them from extending beyond the respective side walls when the blank is assembled to form the box.

In an alternate embodiment, the corner tabs 42 are connected with the side walls 20 and 30 by reversing the respective positions of the corner tab fold lines 43 and the corner tab cut lines 44 and 45. Similarly, the lid corner tabs 122 may be connected to the lid side walls 90 and 92 by reversing the respective positions of the lid corner tab fold lines 124 and the lid corner tab cut lines 126 and 128.

As shown in FIG. 1, the blank may further include a lid hinge tab 130 extending from the upper edge of the second rear wall 58 toward the lid 98. The lid hinge tab 130 is connected to the second rear wall 58 by a portion of the hinge 96 indicated at 96*b*. The tab hinge 96*b* may be perforated to facilitate removal of the lid from the assembled box. In a preferred embodiment, the lid hinge tab 130 is positioned adjacent to and separate from the lid corner tab 122 which is connected to the adjacent edge of the lid rear wall 80 by a lid hinge tab cut line 132. The lid hinge tab 130 may also be tapered to facilitate its arrangement on the lid 98, particularly the lid rear wall 80, when the blank is assembled to form the box.

The blank 10 is preferably made of corrugated cardboard or other paper-based material to provide good thermal insulation qualities. Preferably, the blank 10 is of a material referred to as "F-flute" corrugated material. Using the "F-flute" material allows the present invention to be extremely light in weight while remaining strong, sturdy and durable. The blank 10 used in construction of this invention should be oriented such that a majority of the impressed fold lines are normal to the flutes or corrugations to provide good strength. In a further embodiment, the blank 10 may be coated or treated with a greaseproof or other coating material.

Figure 2:
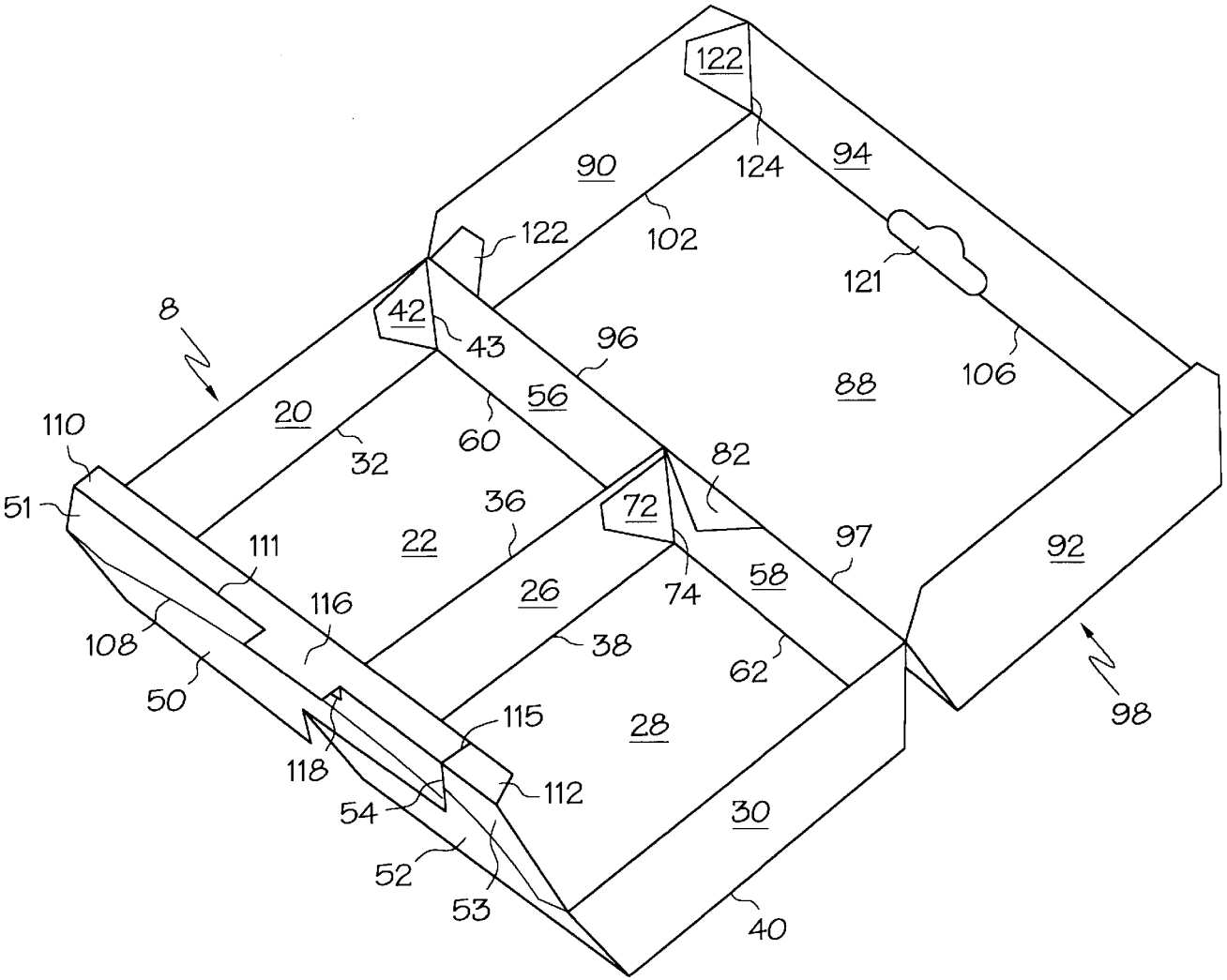
FIG. 2 is a perspective view of a box formed by assembly of the blank of FIG. 1, wherein the lid is open.
Figure 3:
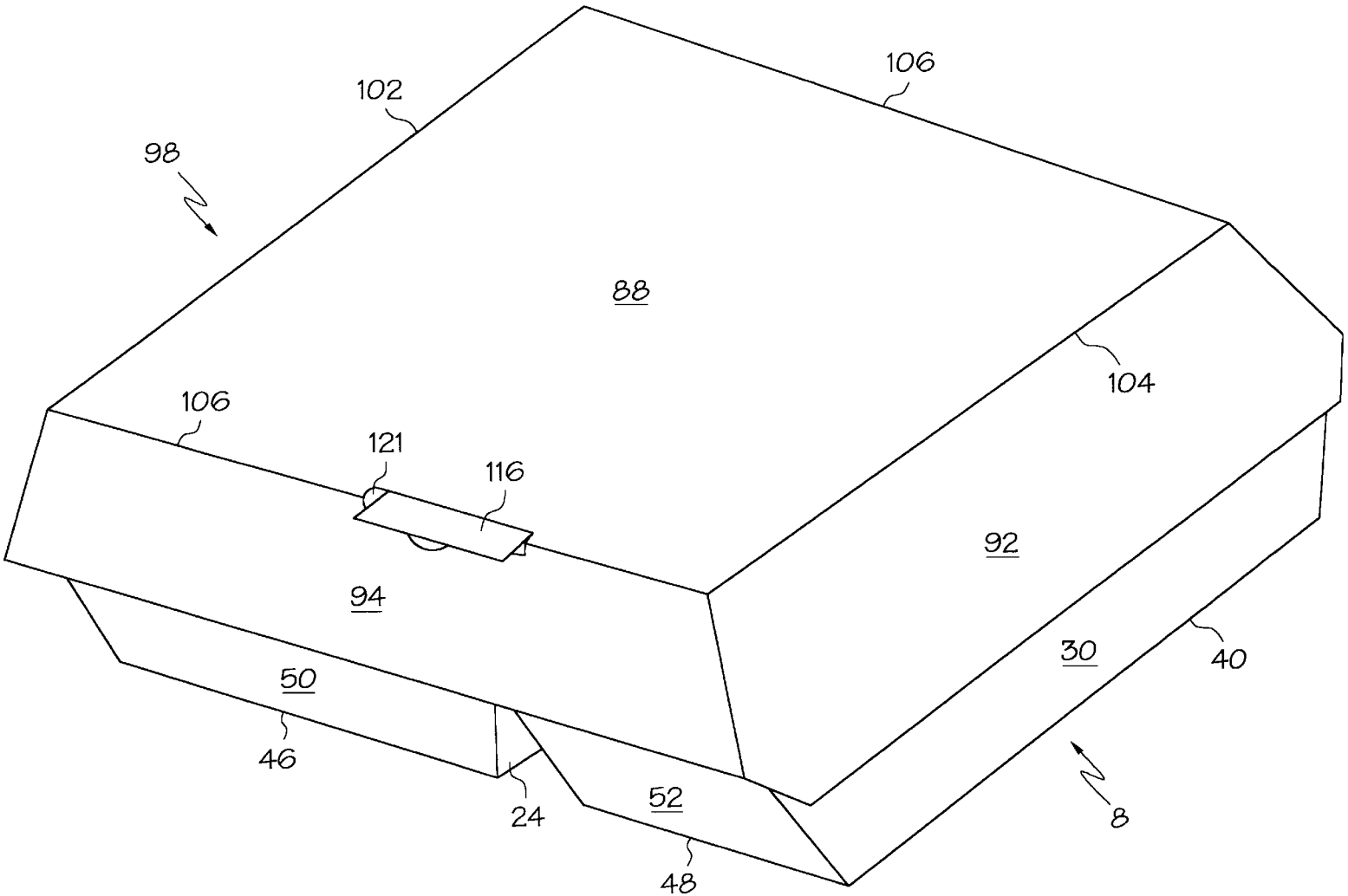
FIG. 3 is a perspective view of the box of FIG. 2, wherein the lid is closed.

As shown in FIGS. 1–3, the front and rear edges of the side walls and the inner and outer edges of the front and rear walls are tapered with respect to the edges of the panels 22 and 28. As such, the tabs attached to the walls in this embodiment are also tapered. As a result of this tapered relationship, a plurality of assembled boxes with opened lids 98, as depicted in FIG. 2, are easily and readily stacked in nested relation to occupy a minimum vertical space, thereby facilitating storage of the assembled box.

In forming the box depicted in FIGS. 2 and 3, parts of the blank 10 shown in FIG. 1 are folded and attached together. As illustrated in FIG. 2, the divider panels 24 and 26 are folded along the divider fold line 36 and the compartment fold lines 34 and 38 to angularly position the divider panels toward one another. The front walls 50 and 52 are folded along front wall fold lines 46 and 48, respectively, so that the inner edges of the front walls are in substantial alignment with the front edges of the divider panels 24 and 26, respectively. The front divider tabs 64 and 65 are folded along front divider tab fold lines 66 and 67, respectively, and are attached to divider panels 24 and 26, respectively, by, for example, an adhesive or the like.

In the embodiment described above wherein a portion of one of the front walls 50 and 52, specifically portion 50*a* in FIG. 1, extends over an area defined by the front divider tabs 64 and 65, the extended front wall portion 50*a* is slid in front of or behind the adjacent front wall 52 and attached thereto by, for example, an adhesive or the like. The closure flaps 110 and 112 are folded along the closure flap fold line 111 so that the interlocking tab 116 extends outwardly from one of the closure extensions 51 and 53.

In a similar manner, the rear walls 56 and 58 are folded along rear wall fold lines 60 and 62, respectively, so that the inner edges of the rear walls are in substantial alignment with the rear edges of the divider panels 24 and 26, respectively. The rear divider tabs 71 and 72 are folded along rear divider tab fold lines 73 and 74, respectively, and are attached to divider panels 24 and 26, respectively, by an adhesive or the like.

As the divider panels are moved toward one another as described above, the top edge of the second rear end wall 58 is slid into substantial alignment with the portion of the lid rear wall 80 defined by the compartment hinge tab 82, if so included, and the rear end wall cut line 86. The compartment hinge tab 82 and the lid hinge tab 130, if included, are folded along hinges 96*a* and 96*b*, respectively, and attached to the second rear end wall 58 and lid rear wall 80, respectively, by an adhesive or the like.

After folding the corner tabs 42 along corner tab fold lines 43, the side walls 20 and 30 are then folded along side wall fold lines 32 and 40, respectively. Once the end edges of the side walls 20 and 30 are in substantial alignment with the respective side edges of the front and rear walls 50, 52, 56, and 58, the side walls are attached to the respective corner tabs 42. The lid rear wall 80 is then folded along hinges 96 and 96*a*.

To assemble the lid portion of the blank shown in FIG. 1, the lid panel 88 is folded along the rear lid fold line 100 and the lid corner tabs 122 connected to the lid rear wall 80 are folded along their lid corner tab fold lines 124. The lid side walls 90 and 92 are folded along the side lid fold lines 102 and 104, respectively, so that the rear end edges of the lid side walls are in substantial alignment with the outer edges of the lid rear wall 80. The lid corner tabs 122 that are connected to the lid rear wall 80 are connected to the lid side walls 90 and 92 by adhesive or the like. The lid corner tabs 122 that are connected to the lid front wall 94 are similarly folded along the respective lid corner tab fold lines 124 and the lid front wall is folded along front lid fold line 106 until the outer edges of the lid front wall are in substantial alignment with the front end edges of the lid side walls 90 and 92. The lid corner tabs 122 that are connected to the lid front wall 94 are then attached to the lid side walls 90 and 92 by adhesive or the like.

In the embodiments described herein, preferably, an adhesive has been pre-applied to the tabs 42, 64, 65, 71, 72, 82, 122, and 130. However, the tabs may be attached or fastened to the respective walls by any other suitable adhesive means, by interlocking slots, or by any means which will be apparent to those of ordinary skill in the art. Although preferably attached to the inside portions of the walls, the tabs 42, 64, 65, 71, 72, 82, 122, and 130 may also be attached to the outside of the walls. The tabs 42, 64, 65, 71, 72, 82, 122, and 130 serve to unify and rigidify the assembled box, although all or some of the tabs described herein may be omitted without departing from the invention. For example, the same respective attachments can be made by securing the respective walls and/or panels together with staples, clips or similar means.

The box of the present invention may be varied in the relative sizes of the compartment panels 22 and 28 by varying the positions of the fold lines 32, 34, 38, and 40. It is generally preferred that the dimensions and taper of the divider panels 24 and 26 be substantially equivalent to those of side walls 20 and 30 so that the divider is of the substantially the same height as the main walls of the assembled box. However, in an alternate embodiment, the height of the divider panels 24 and 26 may be reduced to a shorter height with respect to the side walls 20 and 30. Additionally, the side walls, end walls and closure extensions are preferably dimensioned so that, as shown in FIG. 3, when the lid 98 is closed, the side walls 20 and 30 and closure extensions 51 and 53 are substantially covered by the lid. Thus, there is good coverage by lid 98 over the side walls 20 and 30 and closure extensions 51 and 53 to effectively close the box and protect the contents thereof.

In order latch to the lid 98 to the compartment portion of the box according to the preferred embodiment as shown in FIG. 3, the lid 98 is pivotally moved about the hinge 96, towards the box until the lid front wall 94 is positioned to overhang the closure extensions 51 and 53. The extension fold line 108 provides the closure extensions 51 and 53 with a limited flexibility along the extension fold line that permits the closure extensions to move away from the lid front wall 94 as it is being passed over the closure extensions, and to spring back towards the lid front wall when the interlocking tab 116 is aligned with the slot 121. Thus, the interlocking tab 116 is biased to move into the slot 121 and the lid 98 is latched in a closed position when the lid is closed, as shown in FIG. 3. When it is desired to open the lid 98, the closure extensions 51 and 53 are pushed toward the interior of the box, whereby the interlocking tab 116 is removed from the slot 121. The lid 98 can then be pivotally moved away from the compartment portion of the box. Although this is a preferred means for latching the lid 98 to the compartment portion, other means, such as a releasable adhesive or the like, may alternatively be used.

Having shown and described the preferred embodiments of the present invention, further adaptions of the apparatus described herein can be accomplished by appropriate modifications by one of ordinary skill in the art without departing from the scope of the present invention. A number of alternatives and modifications have been described herein, and others will be apparent to those skilled in the art.

What is claimed is:

1. A unitary blank of semi-rigid material for forming a multi-compartment box, the blank comprising:

first and second divider panels, the divider panels each having opposed front and rear edges and inner and outer edges, the inner edge of the second divider panel being connected to the inner edge of the first divider panel along a divider fold line;

first and second compartment panels, the first and second compartment panels each having opposed front and rear edges and inner and outer edges, the inner edges of the first and second compartment panels being connected respectively to the outer edges of the first and second divider panels respectively along first and second compartment fold lines, each compartment fold being substantially parallel to the divider fold line;

first and second side walls, the first and second side walls each having opposed front and rear edges and inner and outer edges, the inner edges of the first and second side walls being connected respectively to the outer edges of the first and second compartment panels respectively along first and second side wall fold lines, each side wall fold line being substantially parallel to the divider fold line;

first and second front walls having opposed bottom and top edges and inner and outer edges, the bottom edges of the first and second front walls being connected respectively to the front edges of the first and second compartment panels along first and second front wall fold lines;

first and second rear walls having opposed bottom and top edges and inner and outer edges, the bottom edges of the first and second rear walls being connected respectively to the rear edges of the first and second compartment panels along first and second rear wall fold lines;

a lid connected to the first rear wall by a hinge, the hinge extending substantially normal to the divider fold line, first and second front divider tabs, the front divider tabs being connected respectively to the inner edges of the first and second front walls by front divider tab fold lines, bottom edges of the first and second front divider tabs being respectively adjacent to but separated from the front edges of the first and second divider panels by front divider cut lines, inner edges of the first and second front divider tabs being adjacent to but separated from one another by a front divider tab cut line, and top edges of the first and second front divider tabs being spaced from and below the bottom edge of an extended portion of one of the first and second front walls to form a substantially triangular cut out space;

first and second rear divider tabs, the rear divider tabs being connected respectively to the inner edges of the first and second rear walls by rear divider tab fold lines, bottom edges of the rear divider tabs being respectively adjacent to but separated from the rear edges of the first and second divider panels by rear divider cut lines, inner edges of the first and second rear divider tabs being adjacent to but separated from one another by a rear divider tab cut line, and top edges of the first and second rear divider tabs being tapered to prevent the rear divider tabs from extending past the divider panels when the blank is assembled to form a box; and a compartment hinge tab connected to the hinge and including first and second edges respectively adjacent to and separated from the top edges of the first and second rear divider tabs by a compartment hinge tab cut line.

2. A multi-compartment box formed from a unitary blank of semi-rigid material, the blank comprising:

first and second divider panels, the divider panels each having opposed front and rear edges and inner and outer edges, the inner edge of the second divider panel being connected to the inner edge of the first divider panel along a divider fold line;

first and second compartment panels, the first and second compartment panels each having opposed front and rear edges and inner and outer edges, the inner edges of the first and second compartment panels being connected respectively to the outer edges of the first and second divider panels along first and second compartment fold lines, respectively;

first and second side walls, the first and second side walls each having opposed front and rear edges and inner and outer edges, the inner edges of the first and second side walls being connected respectively to the outer edges of the first and second compartment panels along first and second side wall fold lines, respectively;

first and second front walls having opposed bottom and top edges and inner and outer edges, the bottom edges of the first and second front walls being connected respectively to the front edges of the first and second compartment panels along first and second front wall fold lines, respectively;

first and second rear walls having opposed bottom and top edges and inner and outer edges, the bottom edges of the first and second rear walls being connected respectively to the rear edges of the first and second compartment panels along first and second rear wall fold lines, respectively; and a lid connected to the first rear wall by a hinge, the hinge extending substantially normal to the divider fold line.

3. The box of claim 2, further comprising first and second front divider tabs, the front divider tabs each having opposed top and bottom edges and inner and outer edges, the outer edges of the front divider tabs being connected respectively to the inner edges of the first and second front walls by front divider tab fold lines, the bottom edges of the first and second front divider tabs being respectively adjacent to but separated from the front edges of the first and second divider panels by front divider cut lines, and the inner edges of the first and second front divider tabs being adjacent to but separated from one another by a front divider tab cut line.

4. The box of claim 2, wherein the divider fold line is perforated and further wherein the hinge is perforated.

5. The box of claim 2, wherein the lid comprises:

a lid rear wall having opposed bottom and top edges and first and second side edges, the bottom edge of the lid rear wall being connected to the top edge of the first rear wall by the hinge;

a lid panel having opposed front and rear edges and first and second side edges, the rear edge of the lid panel being connected to the top edge of the lid rear wall along a rear lid fold line;

first and second lid side walls, each of the lid side walls having opposed front and rear edges and bottom and top edges, the top edges of the first and second lid side walls being connected respectively to the first and second edges of the lid panel respectively along side lid fold lines; and a lid front wall having opposed bottom and top edges and first and second side edges, the top edge of the lid front wall being connected to the front edge of the lid panel along a front lid fold line.

6. The box of claim 5, further comprising first and second closure extensions having opposed bottom and top edges, the bottom edges of the closure extensions being connected respectively with the top edges of the first and second front walls by an extension fold line, the first and second closure extensions further having inner edges which are adjacent to but separated from one another by a closure extension cut line.

7. The box of claim 6, wherein the extension fold line comprises a substantially arcuate shaped portion.

8. The box of claim 6, wherein a portion of one of the first and second front walls extends over and is spaced from the top edges of the front divider tabs.

9. The box of claim 8, wherein a bottom edge of the front wall extending portion and the top edges of the front divider tabs form a substantially triangular cut out space.

10. The box of claim 6, further comprising first and second closure flaps connected respectively with the top edges of the first and second closure extensions by a closure flap fold line, the first and second closure flaps having inner edges which are adjacent to but separated from one another by a closure flap cut line.

11. The box of claim 10, wherein at least one of the closure flaps includes an interlocking tab and further wherein the lid front wall includes an interlocking slot adapted for engagement with the tab.

12. The box of claim 5, further comprising:

first and second closure extensions having opposed bottom and top edges, the bottom edges of the closure extensions being connected respectively with the top edges of the first and second front walls by an extension fold line having a substantially arcuate shape, the first and second closure extensions further having inner edges which are adjacent to but separated from one another by a closure extension cut line; and first and second closure flaps connected respectively with the top edges of the first and second closure extensions by a closure flap fold line, the first and second closure flaps having inner edges which are adjacent to but separated from one another by a closure flap cut line, the closure flap cut line being colinear with the closure extension cut line, and the closure flap including an interlocking tab cut from an adjacent portion of one of the closure extensions.

13. The box of claim 2, further comprising a compartment hinge tab, the compartment hinge tab being connected to the hinge and extending towards one of the compartments of the box.

14. The box of claim 2, further comprising a lid hinge tab, the lid hinge tab being connected to the top edge of the second rear wall and extending towards the lid of the box.

15. The box of claim 2, further comprising a plurality of corner tabs, each corner tab being connected with the outer edge of one of the first and second front walls and the first and second rear walls by a corner tab fold line.

16. The box of claim 15, wherein each corner tab connected with the rear walls includes an edge adjacent to and separated from a rear edge of a side wall by a rear corner tab cut line, and each corner tab connected with the front walls includes an edge adjacent to and separated from a front edge of a side wall by a front corner tab cut line.

17. The box of claim 2, wherein the compartment fold lines and the side wall fold lines are substantially parallel to the divider fold line.

18. The box of claim 17, further comprising a plurality of lid corner tabs, each lid corner tab being connected with one of the side edges of the lid front wall and the lid rear wall by a lid corner tab fold line.

19. The box of claim 18, wherein each lid corner tab connected with the lid rear wall includes an edge adjacent to and separated from a rear edge of a lid side wall by a rear lid corner tab cut line, and each lid corner tab connected with the front lid wall includes an edge adjacent to and separated from a front edge of a side wall by a front lid corner tab cut line.

20. The box of claim 2, wherein the divider panels, side walls, front walls and rear walls of the box and the lid rear wall, lid side walls, and lid front wall are tapered to allow two boxes to be nested when their respective lids are in an open position.

21. The box of claim 2, further comprising first and second rear divider tabs, the rear divider tabs each having opposed top and bottom edges and inner and outer edges, the outer edges of the first and second rear divider tabs being connected respectively to the inner edges of the first and second rear walls by rear divider tab fold lines, the bottom edges of the rear divider tabs being respectively adjacent to but separated from the rear edges of the first and second divider panels by rear divider cut lines, and the inner edges of the first and second rear divider tabs being adjacent to but separated from one another by a rear divider tab cut line.

22. A multi-compartment box formed from a unitary blank of semi-rigid paper-based material, the blank comprising:

first and second divider panels, the divider panels each having opposed front and rear edges and inner and outer edges, the inner edge of the second divider panel being connected to the inner edge of the first divider panel along a perforated divider fold line, and the front and rear edges of each of the divider panels being tapered inwardly from the inner edge to the outer edge of the respective divider panel;

first and second compartment panels, the first and second compartment panels each having opposed front and rear edges and inner and outer edges, the inner edges of the first and second compartment panels being connected respectively to the outer edges of the first and second divider panels respectively along first and second compartment fold lines, each compartment fold line being substantially parallel to the divider fold line;

first and second side walls, the first and second side walls each having opposed front and rear edges and inner and outer edges, the inner edges of the first and second side walls being connected respectively to the outer edges of the first and second compartment panels respectively along first and second side wall fold lines, each side wall fold line being substantially parallel to the divider fold line, and the front and rear edges of each of the side walls being tapered inwardly from the outer edge to the inner edge of the respective side wall;

first and second front walls having opposed bottom and top edges and inner and outer edges, the bottom edges of the first and second front walls being connected respectively to the front edges of the first and second compartment panels along first and second front wall fold lines, and the inner and outer edges of each of the front walls being tapered inwardly from the top edge to the bottom edge of the respective front wall;

first and second closure extensions having opposed bottom and top edges, the bottom edges of the closure extensions being connected respectively with the top edges of the first and second front walls by an extension fold line having a substantially arcuate shape, the first and second closure extensions further having inner edges which are adjacent to but separated from one another by a closure extension cut line;

first and second closure flaps connected respectively with the top edges of the first and second closure extensions by a closure flap fold line, the first and second closure flaps having inner edges which are adjacent to but separated from one another by a closure flap cut line, the closure flap cut line being colinear with the closure extension cut line, and the closure flap including an interlocking tab;

first and second rear walls having opposed bottom and top edges and inner and outer edges, the bottom edges of the first and second rear walls being connected respectively to the rear edges of the first and second compartment panels along first and second rear wall fold lines, and the inner and outer edges of the rear walls being tapered inwardly from the top edge to the bottom edge of the respective rear wall;

a lid rear wall having opposed bottom and top edges and first and second side edges, the bottom edge of the lid rear wall being connected to the top edge of the first rear wall by a perforated hinge, the hinge extending substantially normal to the divider fold line, and the side edges of the lid rear wall being tapered inwardly from the bottom edge to the top edge of the lid rear wall;

a lid panel having opposed first and second side edges and front and rear edges, the rear edge of the lid panel being connected to the top edge of the lid rear wall along a rear lid fold line;

first and second lid side walls, each of the lid side walls having opposed front and rear edges and bottom and top edges, the top edges of the first and second lid side walls being connected respectively to the first and second edges of the lid panel respectively along side lid fold lines, and the front and rear edges of each of the lid side walls being tapered inwardly from the bottom edge to the top edge of the respective lid side wall;

a lid front wall having opposed bottom and top edges and first and second side edges, the top edge of the lid front wall being connected to the front edge of the lid panel along a front lid fold line whereby the lid rear wall, lid panel, lid side walls, and lid front wall combine to form a lid, and the side edges of the lid front wall being tapered down from the bottom edge to the top edge of the lid front wall, a slot being provided on the lid for receiving the interlocking tab of the closure flap;

first and second front divider tabs, the front divider tabs being connected respectively to the inner edges of the first and second front walls by front divider tab fold lines, bottom edges of the first and second front divider tabs being respectively adjacent to but separated from the front edges of the first and second divider panels by front divider cut lines, inner edges of the first and second front divider tabs being adjacent to but separated from one another by a front divider tab cut line, and top edges of the first and second front divider tabs being spaced from and below the bottom edge of an extended portion of one of the first and second front walls to form a substantially triangular cut out space;

first and second rear divider tabs, the rear divider tabs being connected respectively to the inner edges of the first and second rear walls by rear divider tab fold lines, bottom edges of the rear divider tabs being respectively adjacent to but separated from the rear edges of the first and second divider panels by rear divider cut lines, inner edges of the first and second rear divider tabs being adjacent to but separated from one another by a rear divider tab cut line, and top edges of the first and second rear divider tabs being tapered to prevent the rear divider tabs from extending past the divider panels when the blank is assembled to form the box;

a compartment hinge tab connected to the hinge and extending towards one of the compartments;

a lid hinge tab being connected to the hinge and extending towards the lid;

a plurality of corner tabs connected with the outer edges of the first and second front walls and the first and second rear walls by corner tab fold lines; and a plurality of lid corner tabs connected with the side edges of the lid front wall and the lid rear wall by lid corner tab fold lines.

23. A unitary blank of semi-rigid material for forming a multi-compartment box, the blank comprising:

first and second divider panels, the divider panels each having opposed front and rear edges and inner and outer edges, the inner edge of the second divider panel being connected to the inner edge of the first divider panel along a divider fold line;

first and second compartment panels, the first and second compartment panels each having opposed front and rear edges and inner and outer edges, the inner edges of the first and second compartment panels being connected respectively to the outer edges of the first and second divider panels respectively along first and second compartment fold lines, each compartment fold being substantially parallel to the divider fold line;

first and second side walls, the first and second side walls each having opposed front and rear edges and inner and outer edges, the inner edges of the first and second side walls being connected respectively to the outer edges of the first and second compartment panels respectively along first and second side wall fold lines, each side wall fold line being substantially parallel to the divider fold line;

first and second front walls having opposed bottom and top edges and inner and outer edges, the bottom edges of the first and second front walls being connected respectively to the front edges of the first and second compartment panels along first and second front wall fold lines;

first and second rear walls having opposed bottom and top edges and inner and outer edges, the bottom edges of the first and second rear walls being connected respectively to the rear edges of the first and second compartment panels along first and second rear wall fold lines; and a lid connected to the first rear wall by a hinge, the hinge extending substantially normal to the divider fold line, and the lid comprising a lid rear wall, a rectangular lid panel, first and second lid side walls connected to the lid panel, and a lid front wall.

24. A unitary blank of semi-rigid material for forming a multi-compartment box, the blank comprising:

first and second divider panels, the divider panels each having opposed front and rear edges and inner and outer edges, the inner edge of the second divider panel being connected to the inner edge of the first divider panel along a divider fold line;

first and second compartment panels, the first and second compartment panels each having opposed front and rear edges and inner and outer edges, the inner edges of the first and second compartment panels being connected respectively to the outer edges of the first and second divider panels respectively along first and second compartment fold lines, each compartment fold being substantially parallel to the divider fold line;

first and second side walls, the first and second side walls each having opposed front and rear edges and inner and outer edges, the inner edges of the first and second side walls being connected respectively to the outer edges of the first and second compartment panels respectively along first and second side wall fold lines, each side wall fold line being substantially parallel to the divider fold line;

first and second front walls having opposed bottom and top edges and inner and outer edges, the bottom edges of the first and second front walls being connected respectively to the front edges of the first and second compartment panels along first and second front wall fold lines;

first and second rear walls having opposed bottom and top edges and inner and outer edges, the bottom edges of the first and second rear walls being connected respectively to the rear edges of the first and second compartment panels along first and second rear wall fold lines; and a lid connected to the first rear wall by a hinge, the hinge extending substantially normal to the divider fold line, wherein the lid comprises:

a lid rear wall having opposed bottom and top edges and first and second side edges, the bottom edge of the lid rear wall being connected to the top edge of the first rear wall by the hinge;

a lid panel having opposed front and rear edges and first and second side edges, the rear edge of the lid panel being connected to the top edge of the lid rear wall along a rear lid fold line;

first and second lid side walls, each of the lid side walls having opposed front and rear edges and bottom and top edges, the top edges of the first and second lid side walls being connected respectively to the first and second edges of the lid panel respectively along side lid fold lines; and a lid front wall having opposed bottom and top edges and first and second side edges, the top edge of the lid front wall being connected to the front edge of the lid panel along a front lid fold line.

* * * * *